US007536737B1

(12) United States Patent
Orta-Perez

(10) Patent No.: US 7,536,737 B1
(45) Date of Patent: May 26, 2009

(54) METHOD WITH APPARATUS TO PREVENT BALDNESS AND STIMULATE HAIR GROWTH

(76) Inventor: Lazaro Orta-Perez, 710 SW. 114 Ave., #B6, Miami, FL (US) 33174

( * ) Notice: Subject to any disclaimer, the term of this patent is extended or adjusted under 35 U.S.C. 154(b) by 25 days.

(21) Appl. No.: 11/941,235

(22) Filed: Nov. 16, 2007

(51) Int. Cl.
*A47C 9/00* (2006.01)

(52) U.S. Cl. ..... 5/640; 5/636; 5/657

(58) Field of Classification Search ..... 5/636, 5/640, 657, 610, 622
See application file for complete search history.

(56) References Cited

U.S. PATENT DOCUMENTS 12,952 A * 5/1855 Reich ..... 14/34
3,139,631 A * 7/1964 Kiefer ..... 5/643
5,416,939 A * 5/1995 Maalouli ..... 5/610

FOREIGN PATENT DOCUMENTS

DE 4105926 A1 8/1992
JP 2005124731 A 5/2005

* cited by examiner

*Primary Examiner*—Fredrick Conley
(74) *Attorney, Agent, or Firm*—Albert Bordas, P.A.

(57) ABSTRACT

An apparatus in combination with a pillow to prevent baldness and stimulate hair growth. It comprises a base plate, a top plate, and a bladder that contains gaseous, liquid, or semi-solid matter. The bladder is positioned in between the base plate and the top plate. The apparatus also comprises pivoting means, whereby the pivoting means causes the top plate, having a pillow placed thereon, to contact at least an uppermost area of a human head and on upper and/or lateral and/or posterior areas of said head for scalp stimulation to promote hair growth and prevent alopecia.

12 Claims, 3 Drawing Sheets

METHOD WITH APPARATUS TO PREVENT BALDNESS AND STIMULATE HAIR GROWTH

BACKGROUND OF THE INVENTION

1. Field of the Invention

The present invention relates to hair growth, and more particularly, to an apparatus to prevent baldness and stimulate hair growth.

2. Description of the Related Art

Baldness, also known as alopecia and hair loss, involves the state of lacking hair where it often grows, especially on the head. The most common form of baldness is a progressive hair thinning condition called androgenic alopecia or "male pattern baldness" that occurs in adult male humans and other species. The severity and nature of baldness can vary greatly; it ranges from male and female pattern alopecia (androgenetic alopecia, also called androgenic alopecia or alopecia androgenetica), alopecia greata, which involves the loss of some of the hair from the head, and alopecia totalis, which involves the loss of all head hair, to the most extreme form, alopecia universalis, which involves the loss of all hair from the head and the body.

Treatments for the various forms of alopecia have limited success. Some hair loss sufferers make use of topically applied solutions in an attempt to prevent further loss and regrow hair. As a general rule, it is easier to maintain remaining hair than it is to regrow it. However, more aggressive treatments, such as cosmetic transplant surgery and hair replacement systems, can help. Unfortunately, these aggressive treatments have high costs and most individuals suffering baldness cannot afford them. Another known treatment is low-level laser therapy, where a low level laser is shone directly on the scalp to stimulate hair growth through "Photo-Biostimulation" of hair follicles. However, there is some debate over the FDA's approval and its effectiveness.

The fact is, that most adults are afraid of baldness and persons who suffer it are constantly looking for a solution. As alopecia is caused due to shrinkage of hair follicle by poor blood circulation, resulting from capillary contraction, stimulation of the scalp is effective for hair growth and preventing alopecia. Brushes and massage machines have also been used for scalp massaging in an effort to prevent alopecia and promote hair growth. However, a person typically only uses these types of machines for a few minutes a day, if that much.

Applicant believes that one of the closest references corresponds to German Patent No. DE4105926, issued on Aug. 27, 1992 to Hamid Emarati for a cushion for head of bald man. It incorporates an angled holder, an air circulation duct, and a covering with a rectangular heating plate. However, it differs from the present invention, because Emarati teaches a cushion having an angle holder and, if necessary, an air-circulation duct, a soft layer and a covering. The temperature remains evenly high in the largest part of the top of the user's head. The cushion contains a rectangular fixed plate, the sides of which cover the head surface on at least two sides. The heated air beneath the user's head is carried upwards onto the head surface through a duct inside the pillow.

Applicant believes that another reference corresponds to Japanese Patent No. JP2005124731 issued to Ryoju Ihara on May 19, 2005 for a baldness preventing apparatus having stress alleviation and relaxing effect by acupressure effect. However, it differs from the present invention, because Ihara teaches a baldness preventing apparatus formed with projections having rigidity for effectively stimulating the scalp and projections having a structure of effectively stimulating the scalp on its surface. It can adjust the strength of the acupressure operation of the projections using a stimulation-adjusting sheet. The use of a texture material for the stimulation adjusting sheet prevents sticking of the sebum of the scalp to the projections and the stimulation adjusting sheet getting dirty by sticking the sebum thereto as washable to be used cleanly at all times.

Each of the above-mentioned references fail to provide a contact surface that cooperatively contours any variety of different human head shapes to stimulate hair growth.

Other patents describing the closest subject matter provide for a number of more or less complicated features that fail to solve the problem in an efficient and economical way. None of these patents suggest the novel features of the present invention.

SUMMARY OF THE INVENTION

The instant invention is an apparatus in combination with a pillow to prevent baldness and stimulate hair growth. It comprises a base plate that has a first transversal edge, first and second lateral edges, and a lip that defines an edge opposite to the first transversal edge. The first and second lateral edges have respective first and second hinge walls approximately perpendicular to the base plate, at a first predetermined distance from the lip without reaching the first transversal edge. Each of the first and second hinge walls comprises a first hole to receive a pin.

The instant invention also has a top plate that is partially concave in shape and has second and third transversal edges, and third and fourth lateral edges. The second transversal edge is opposite to the third transversal edge. The third and fourth lateral edges have respective third and fourth hinge walls approximately perpendicular to the top plate, at a second predetermined distance from the second transversal edge without reaching the third transversal edge. Each of the third and fourth hinge walls comprises a second hole to receive the pin.

The instant invention further has a bladder that contains gaseous, liquid, or semi-solid matter, positioned in between the base plate and the top plate, and pivoting means whereby a predetermined force placed upon the top plate within the second predetermined distance causes the top plate to pivot upon the pins, thereby reducing a third predetermined distance between the lip and the second transversal edge, and thereby increasing a fourth predetermined distance between the first transversal edge and the third transversal edge. The pivoting means causes the top plate, having a pillow placed thereon, to contact at least an uppermost area of a human head for scalp stimulation to promote hair growth and prevent alopecia.

The apparatus in combination with a pillow to prevent baldness and stimulate hair growth further comprises physically massaging the human head at predetermined times to further promote hair growth and prevent alopecia.

It is therefore one of the main objects of the present invention to provide a method with apparatus to prevent baldness and stimulate hair growth that is effective.

It is another object of this invention to provide a method with apparatus to prevent baldness and stimulate hair growth that is comfortable for sleeping.

It is another object of this invention to provide a method with apparatus to prevent baldness and stimulate hair growth that cooperatively contours any variety of different human head shapes.

It is another object of this invention to provide a method with apparatus to prevent baldness and stimulate hair growth for use while laying a head on a pillow.

It is yet another object of this invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1A:
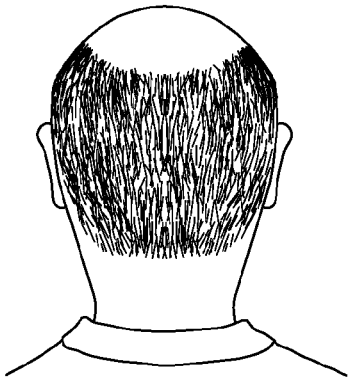
FIG. 1A represents a rear schematic view of a person with a substantially rounded head shape.

Referring now to the drawings, the apparatus of the instant invention is generally referred to with numeral 10. It can be observed that it basically includes base plate 20, bladder 50, and top plate 60.

Figure 2A:
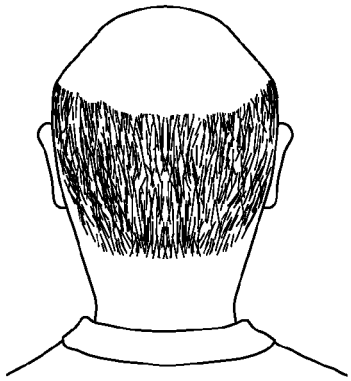
FIG. 2A represents a rear schematic view of a person with a head shape having lateral depressions.
Figure 3A:
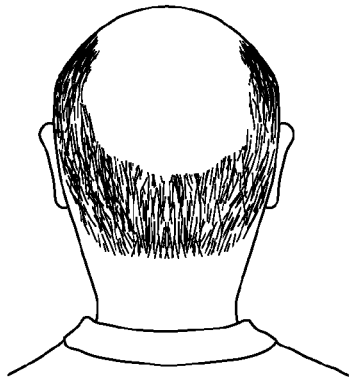
FIG. 3A represents a rear schematic view of a person with a head shape having a posterior depression.
Figure 1B:
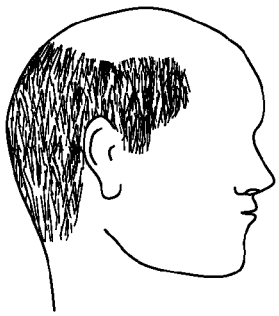
FIG. 1B represents a side schematic view of the person represented in FIG. 1A, showing hair loss on an upper area of the head.
Figure 2B:
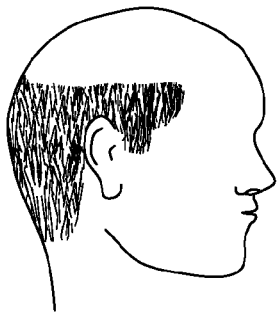
FIG. 2B represents a side schematic view of the person represented in FIG. 2A, showing hair loss on upper and lateral areas of the head.
Figure 3B:
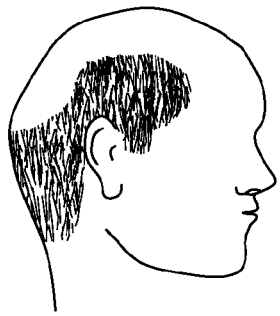
FIG. 3B represents a side schematic view of the person represented in FIG. 3A, showing hair loss on upper and posterior areas of the head.

As seen in FIGS. 1A and 1B, a person with a substantially rounded head shape, mostly suffers hair loss on an upper area of the head only. As best seen in FIGS. 2A and 2B, a person with a head shape having lateral depressions, mostly suffers hair loss on upper and lateral areas of the head. As best seen in FIGS. 3A and 3B, a person with a head shape having a posterior depression, mostly suffers hair loss on upper and posterior areas of the head. Thus, there is a strong correlation demonstrating that typical male pattern baldness depends on the different forms or shapes of heads.

Figure 4:
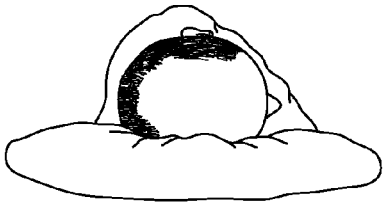
FIGS. 4; 5; and 6 show a prior art pillow, wherein the pillow fails to make physical contact on upper and/or lateral and/or posterior areas of the head.
Figure 5:
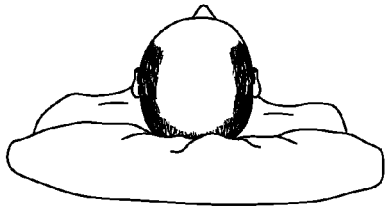
Figure 6:
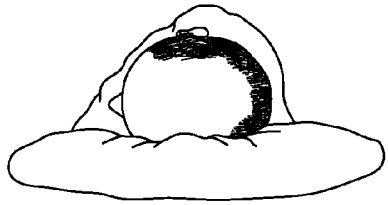
Fig. 6 PRIOR ART

Most people rest and/or sleep approximately 5 to 10 hours for each 24-hour period. As seen in FIGS. 4; 5 and 6, a prior art pillow fails to make physical contact on upper and/or lateral and/or posterior areas of the head. The failure to make contact on upper and/or lateral and/or posterior areas of the head enhance alopecia and hair loss since there is no stimulation of the scalp during the rest and/or sleep time defined above.

The apparatus of the instant invention 10, prevents baldness and stimulates hair growth by making a pillow P make contact on upper and/or lateral and/or posterior areas of a head to prevent alopecia and hair loss with stimulation of the scalp during rest and/or sleep time.

Figure 7:
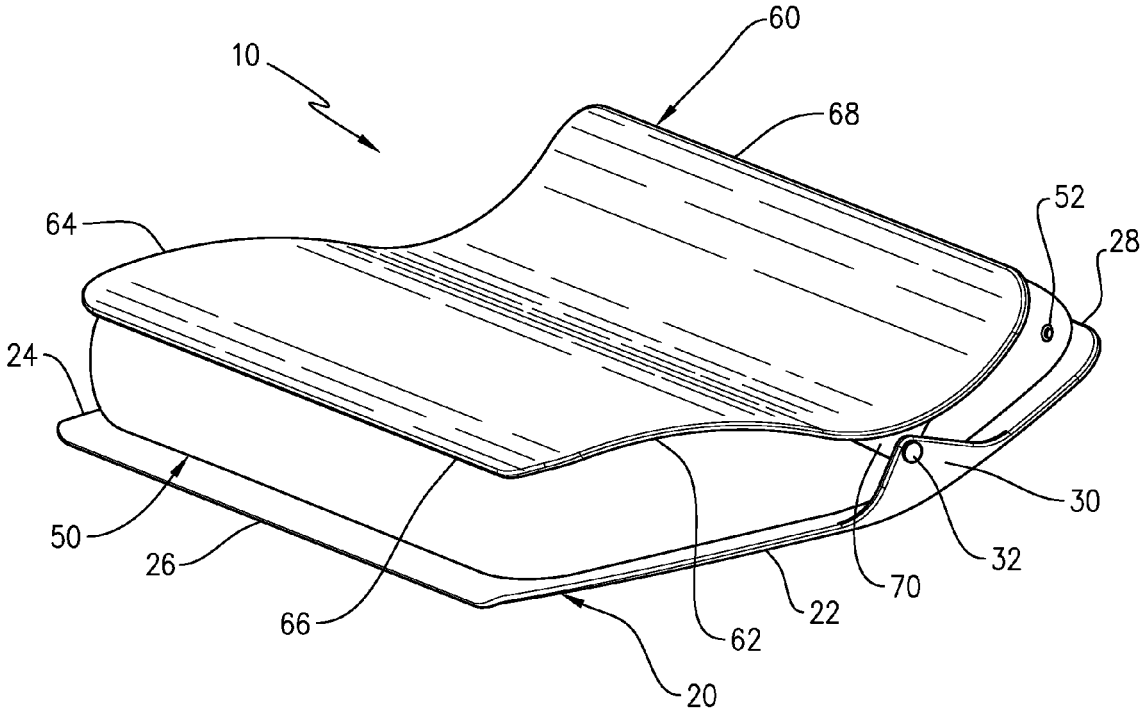
FIG. 7 is an isometric view of the apparatus of the instant invention.

As seen in FIG. 7, base plate 20 has a substantially rectangular shape with lateral edges 22 and 24, lip 26 and transversal edge 28. Lip 26 defines an edge opposite to transversal edge 28. Each of lateral edges 22 and 24 has a hinge wall 30 at a first predetermined distance from lip 26 without reaching transversal edge 28. Each hinge wall 30 comprises a hole to receive a pin 32. A first section of base plate 20, from lip 26 to hinge wall 30, is substantially flat, while a second section of base plate 20, from hinge wall 30 to transversal edge 28, is at an angle with respect to the former.

Top plate 60 has a substantially rectangular shape with lateral edges 62 and 64, and transversal edges 66 and 68 opposite to each other. Each of lateral edges 62 and 64 has a hinge wall 70 at a second predetermined distance from transversal edge 66 without reaching transversal edge 68. Hinge walls 70 are disposed approximately perpendicular to top plate 60. Each hinge wall 70 comprises a hole to receive pin 32. A first portion of top plate 60, from transversal edge 66 to hinge wall 70, is substantially flat, while a second portion of top plate 60, from hinge wall 70 to transversal edge 68, is at an angle with respect to the former, being partially concave in shape to contour any shape of a human head placed upon it.

Figure 8:
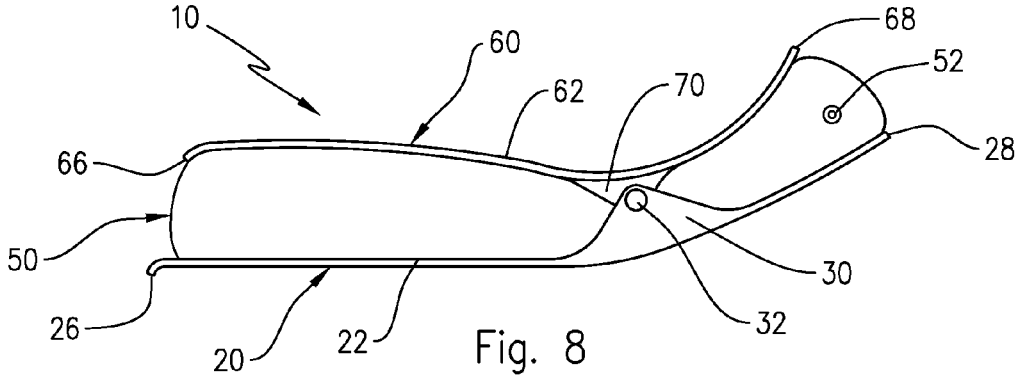
FIG. 8 is a side view of the apparatus of the instant invention at rest when not being used.

As seen in FIG. 8, in the preferred embodiment, the angled portion of top plate 60 is more pronounced than the angled portion of base plate 20. Hinge walls 30 are approximately perpendicular to base plate 20 and hinge walls 70 are approximately perpendicular to top plate 60. Base plate 20 and top plate 60 are hingedly mounted with pins 32 that rotatably pass through the respective holes of hinge walls 30 and 70.

Figure 9:
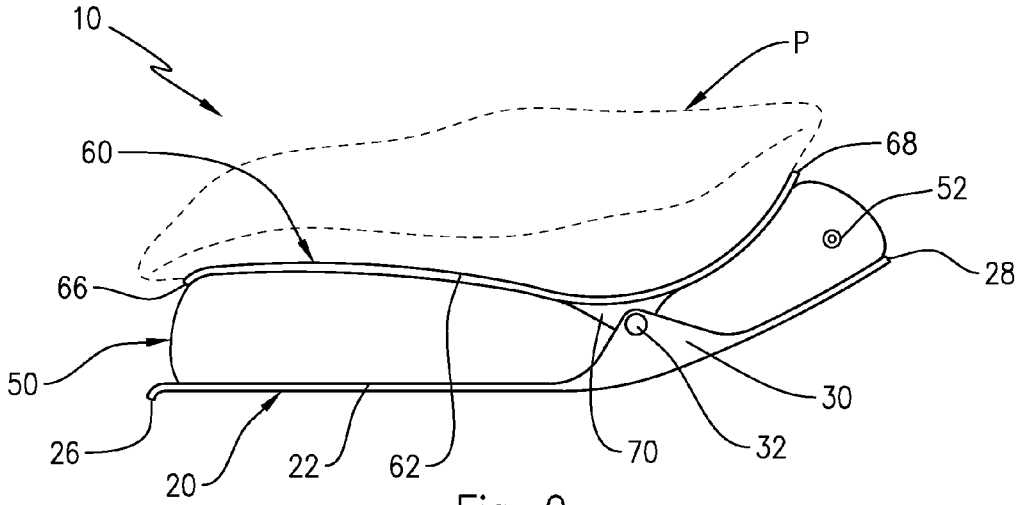
FIG. 9 is a side view of the apparatus of the instant invention at rest with a pillow placed upon it.
Figure 10:
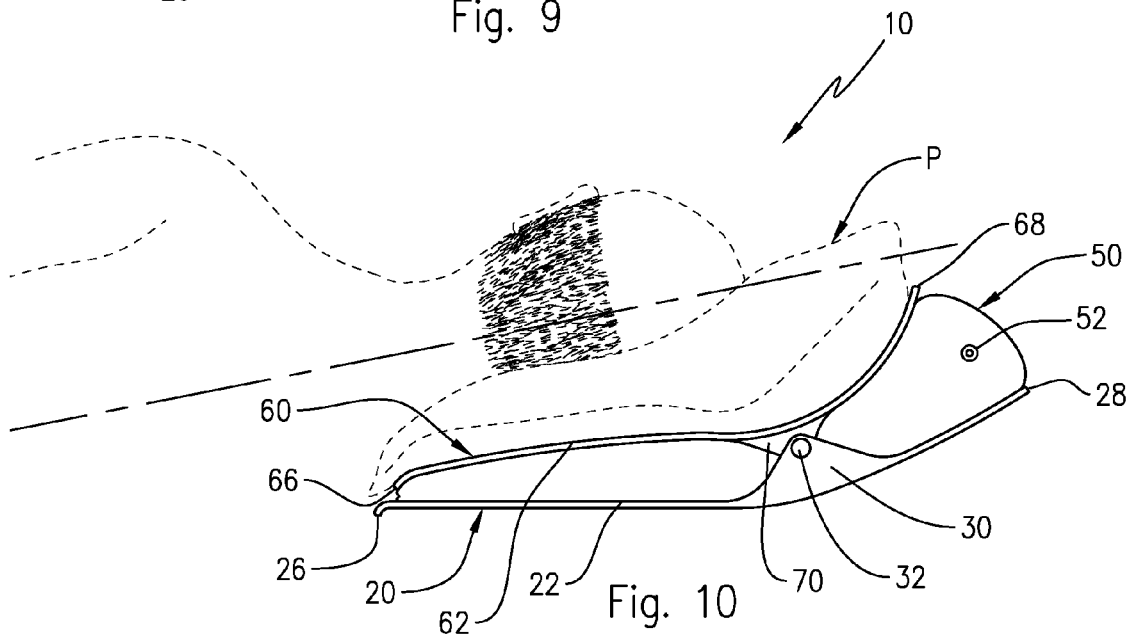
FIG. 10 is a side view of the apparatus of the instant invention in use by a person, wherein the pillow makes physical contact on upper and/or lateral and/or posterior areas of the head.

As seen in FIGS. 8, 9 and 10, bladder 50 is positioned in between base plate 20 and top plate 60. Bladder 50 contains gaseous, liquid, or semi-solid matter. Bladder 50 can be filled through valve 52. It is noted that depending on the weight of a user's head, the amount or volume of gaseous, liquid, or semi-solid matter can be regulated so that the pivoting means causes top plate 60, having pillow P placed thereon, as seen in FIGS. 9 and 10, to contact at least an uppermost area of a human head for scalp stimulation to promote hair growth and prevent alopecia.

As best seen in FIG. 10, pins 32 provide the pivoting means, whereby a predetermined force, such as a human head, placed upon top plate 60, within said second predetermined distance, causes top plate 60 to pivot upon pins 32, thereby reducing a third predetermined distance between lip 26 and transversal edge 66, and thereby increasing a fourth predetermined distance between transversal edges 28 and 68. It is notice that the pivoting point is closer to transversal edges 28 and 68 than to lip 26. The pivoting means causes top plate 60, having pillow P placed thereon, to contact at least an uppermost area of a human head, therefore making contact on upper and/or lateral and/or posterior areas of the head for scalp stimulation to promote hair growth and prevent alopecia.

As best seen in FIG. 10, when apparatus 10 is used, the weight of the upper portion of the user, namely his/her head, makes top plate 60 compress bladder 50 against base plate 20 in a way that the air, liquid of semi-solid matter is displaced into the portion next to transversal edges 28 and 68, urging pillow P to contact at least an uppermost area of a human head, therefore making contact on upper and/or lateral and/or posterior areas of the head for scalp stimulation to promote hair growth and prevent alopecia while the user is resting and/or sleeping. Base plate 20 and top plate 60 are made out of a flexible plastic material, preferably, so the use of apparatus 10 with pillow P provides a comfortable resting area to the user.

In order to further promote hair growth and prevent alopecia, physical fingertip scalp massage at predetermined times can be performed when apparatus 10 of the instant invention is not being used.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. An apparatus in combination with a pillow to prevent baldness and stimulate hair growth, comprising:

A) a base plate having a first transversal edge, first and second lateral edges, and a lip defining an edge opposite to said first transversal edge, said first and second lateral edges having respective first and second hinge walls at a first predetermined distance from said lip without reaching said first transversal edge, said first and second hinge walls each comprising a first hole to receive a pin;

B) a top plate having second and third transversal edges, and third and fourth lateral edges, said second transversal edge being opposite to said third transversal edge, said third and fourth lateral edges having respective third and fourth hinge walls at a second predetermined distance from said second transversal edge without reaching said third transversal edge, said third and fourth hinge walls each comprising a second hole to receive said pin;

C) a bladder positioned in between said base plate and said top plate; and

D) pivoting means whereby a human head placed upon said top plate within said second predetermined distance causes said top plate to pivot upon said pins, thereby reducing a third predetermined distance between said lip and said second transversal edge, and thereby increasing a fourth predetermined distance between said first transversal edge and said third transversal edge.

2. The apparatus in combination with a pillow to prevent baldness and stimulate hair growth set forth in claim 1, further characterized in that said pivoting means causes said top plate, having a pillow placed thereon, to contact at least an uppermost area of said human head and upper or lateral or posterior areas of said human head, for scalp stimulation to promote hair growth and prevent alopecia.

3. The apparatus in combination with a pillow to prevent baldness and stimulate hair growth set forth in claim 1, further characterized in that said top plate is partially concave in shape to contour said human head placed upon it.

4. The apparatus in combination with a pillow to prevent baldness and stimulate hair growth set forth in claim 1, further characterized in that said bladder contains gaseous, liquid, or semi-solid matter.

5. The apparatus in combination with a pillow to prevent baldness and stimulate hair growth set forth in claim 1, further characterized in that said first and second hinge walls are approximately perpendicular to said base plate.

6. The apparatus in combination with a pillow to prevent baldness and stimulate hair growth set forth in claim 1, further characterized in that said third and fourth hinge walls are approximately perpendicular to said top plate.

7. An apparatus in combination with a pillow to prevent baldness and stimulate hair growth, comprising:

A) a base plate having a first transversal edge, first and second lateral edges, and a lip defining an edge opposite to said first transversal edge, said first and second lateral edges having respective first and second hinge walls at a first predetermined distance from said lip without reaching said first transversal edge, said first and second hinge walls each comprising a first hole to receive a pin;

B) a top plate having second and third transversal edges, and third and fourth lateral edges, said second transversal edge being opposite to said third transversal edge, said third and fourth lateral edges having respective third and fourth hinge walls at a second predetermined distance from said second transversal edge without reaching said third transversal edge, said third and fourth hinge walls each comprising a second hole to receive said pin;

C) a bladder positioned in between said base plate and said top plate; and

D) pivoting means whereby a human head placed upon said top plate within said second predetermined distance causes said top plate to pivot upon said pins, thereby reducing a third predetermined distance between said lip and said second transversal edge, and thereby increasing a fourth predetermined distance between said first transversal edge and said third transversal edge, said pivoting means causes said top plate, having a pillow placed thereon, to contact at least an uppermost area of said human head and upper or lateral or posterior areas of said human head for scalp stimulation to promote hair growth and prevent alopecia.

8. The apparatus in combination with a pillow to prevent baldness and stimulate hair growth set forth in claim 7, further characterized in that said top plate is partially concave in shape to contour said human head placed upon it.

9. The apparatus in combination with a pillow to prevent baldness and stimulate hair growth set forth in claim 8, further characterized in that said bladder contains gaseous, liquid, or semi-solid matter.

10. The apparatus in combination with a pillow to prevent baldness and stimulate hair growth set forth in claim 9, further characterized in that said first and second hinge walls are approximately perpendicular to said base plate.

11. The apparatus in combination with a pillow to prevent baldness and stimulate hair growth set forth in claim 10, further characterized in that said third and fourth hinge walls are approximately perpendicular to said top plate.

12. The apparatus in combination with a pillow to prevent baldness and stimulate hair growth set forth in claim 11, further comprising physically massaging said at least an uppermost area of said human head at predetermined times to further promote hair growth and prevent alopecia.

* * * * *